US011525417B2

(12) United States Patent
Paschereit et al.

(10) Patent No.: US 11,525,417 B2
(45) Date of Patent: Dec. 13, 2022

(54) METHOD FOR CONTROLLING A COMBUSTION APPARATUS AND CONTROL DEVICE

(71) Applicant: Technische Universität Berlin, Berlin (DE)

(72) Inventors: Christian Oliver Paschereit, Berlin (DE); Aditya Saurabh, Berlin (DE); Lipika Kabiraj, Berlin (DE)

(73) Assignee: Technische Universität Berlin, Berlin (DE)

( * ) Notice: Subject to any disclaimer, the term of this patent is extended or adjusted under 35 U.S.C. 154(b) by 488 days.

(21) Appl. No.: 16/638,408

(22) PCT Filed: Aug. 21, 2018

(86) PCT No.: PCT/EP2018/072484
§ 371 (c)(1),
(2) Date: Feb. 11, 2020

(87) PCT Pub. No.: WO2019/042813
PCT Pub. Date: Mar. 7, 2019

(65) Prior Publication Data

US 2020/0200110 A1 Jun. 25, 2020

(30) Foreign Application Priority Data

Sep. 1, 2017 (EP) ..... 17189064

(51) Int. Cl.
*F02D 41/14* (2006.01)

(52) U.S. Cl.
CPC .... *F02D 41/1402* (2013.01); *F02D 2041/143* (2013.01); *F02D 2041/1426* (2013.01);
(Continued)

(58) Field of Classification Search
CPC ..... F02D 41/1402; F02D 2041/1426; F02D 2041/143; F23N 2225/04; F23N 2225/08;
(Continued)

(56) References Cited

U.S. PATENT DOCUMENTS 10,095,247 B2 * 10/2018 Unni ..... G06N 7/005
2018/0283305 A1 * 10/2018 Urano ..... F02D 41/2474

FOREIGN PATENT DOCUMENTS

EP 1429003 A2 6/2004
KR 101667104 B1 10/2016
(Continued)

OTHER PUBLICATIONS

"International Application No. PCT/EP2018/072484, International Search Report and Written Opinion dated Nov. 20, 2018", (dated Nov. 20, 2018), 12 pgs.

*Primary Examiner* — Freddie Kirkland, III
(74) *Attorney, Agent, or Firm* — Schwegman Lundberg & Woessner, P.A.

(57) ABSTRACT

A method for controlling a combustion apparatus having a combustion state in which a parameter related to the combustion state reflects a chaotic behavior is provided. The method includes the steps of measuring the parameter and determining a time series of the parameter, shifting the time series by a variable time delay for determining a time-shifted signal, and forming a difference between the time-shifted signal and the time series for determining a time dependent first signal, so that a norm of the difference is lowest. A time dependent second signal is determined, wherein determining the time dependent second signal includes at least one of using a frequency of a desired oscillating combustion state, and shifting the time series by a set time delay. The first
(Continued)

signal and the second signal are combined to determine a control signal. The control signal is used to influence the combustion apparatus.

15 Claims, 2 Drawing Sheets

(52) U.S. Cl.
CPC ..... *F23N 2225/04* (2020.01); *F23N 2225/08* (2020.01); *F23N 2241/20* (2020.01)

(58) Field of Classification Search
CPC ..... F23N 2241/20; F23N 2223/06; F23N 2223/10; F23N 5/203; F23N 5/02; F23N 5/08; F23N 5/16; F23N 5/242
See application file for complete search history.

(56) References Cited

FOREIGN PATENT DOCUMENTS

| | | | |
|---|---|---|---|
| WO | WO-8503761 | A1 | 8/1985 |
| WO | WO-2019042813 | A1 | 3/2019 |

* cited by examiner

METHOD FOR CONTROLLING A COMBUSTION APPARATUS AND CONTROL DEVICE

PRIORITY CLAIM TO RELATED APPLICATIONS

This application is a U.S. national stage filing under 35 U.S.C. § 371 from International Application No. PCT/EP2018/072484, filed on 21 Aug. 2018, and published as WO2019/042813 on 7 Mar. 2019, which claims the benefit under 35 U.S.C. 119 to European Application No. 17189064.3, filed on 1 Sep. 2017, the benefit of priority of each of which is claimed herein, and which applications and publication are hereby incorporated herein by reference in their entirety.

TECHNICAL FIELD

Embodiments of the present invention relate to methods and control devices for physical and chemical apparatuses in which undesired oscillations may emerge spontaneously due to a feedback coupling, in particular to methods and control devices for a combustion apparatus.

BACKGROUND

Feedback coupling is inherent to many practical systems, and leads to oscillatory states (periodic states such as limit cycles and aperiodic states such as chaos) that may adversely affect the stability and safety of the systems such as an apparatus or even a whole plant. For example, a so-called thermoacoustic coupling may occur in apparatuses (systems) such as gas turbine engines, furnaces, boilers, rocket engines, and afterburners that are driven by confined combustion. Thermoacoustic coupling may lead to a self-excited instability, (also known as combustion instability, rumble, and reheat buzz), which appears spontaneously in the form of large amplitude pressure and heat release rate oscillations. The instability may be hazardous for the apparatus. Therefore, it is often desirable to suppress the thermoacoustic instabilities. Previously used control attempts (implicitly) assumed that the thermoacoustic instabilities correspond to limit cycle oscillations, possibly with harmonics. Therefore, the fact that the thermoacoustic system can undergo bifurcations to more complex nonlinear states, such as chaos is not taken into account. In fact, it is even possible that at onset of the instability when the system has just crossed the stability boundary, thermoacoustic oscillations correspond to a chaotic state. Previous methods will fail outright in such a scenario.

Accordingly, there is a need to improve control/suppression of instabilities.

SUMMARY

According to an embodiment of a method for controlling a combustion apparatus having a combustion state in which a parameter related to the combustion state reflects a chaotic behavior, the method includes measuring the parameter and determining a time series of the parameter. The time series is shifted by a variable time delay for determining a time-shifted signal, and for forming a difference between the time-shifted signal and the time series for determining a time dependent first signal, so that a norm of the difference between the time-shifted signal and the time series is lowest. A time dependent second signal different to the first signal is determined. Determining the time dependent second signal includes at least one of using a frequency of a desired periodic combustion state of the combustion apparatus, and shifting the time series by a set time delay. The first signal and the second signal are combined for determining a control signal. The control signal is used to influence the combustion apparatus.

In the following, the difference between the time-shifted signal and the time series is also referred to as (time dependent) difference signal.

In the following, the combustion state in which the parameter related to the combustion state reflects a chaotic behavior, typically a chaotic thermoacoustic instability, is also referred to as chaotic combustion state and chaotic state of combustion, respectively.

The term "chaotic state" as used in this specification intends to describe a state of a system or apparatus exhibiting an aperiodic long-term behaviour with sensitive dependence on initial conditions. The term "aperiodic long-term behaviour" intends to describe that in the asymptotic dynamics the system or apparatus does not correspond to a fixed-point, a periodic orbit or a quasi-periodic behaviour. The system or apparatus may be (describable as) a non-linear deterministic system or apparatus, i.e. a system or apparatus in which the chaotic behaviour is not due to noisy or random forces, but rather due to the nonlinearity present in the system or apparatus, in particular a nonlinearity in the feedback coupling mechanism associated with thermoacoustic instability in the system or apparatus. The term "sensitive dependence on initial conditions" intends to describe that nearby initial conditions separate exponentially fast while the system or apparatus evolves in time.

The method allows transferring the combustion apparatus from the chaotic combustion state into a periodic combustion state, and subsequently into a periodic state with a dominant frequency (of the parameter) shifted to the frequency of the desired oscillating state and/or a periodic state with reduced amplitude of oscillations compared to the initial state. Accordingly, hazardous instabilities of the combustion apparatus such as high mechanical loading can reliably be dampened or even suppressed. Further, other undesired effects that may occur in the chaotic state such as deterioration of exhaust values and exceeding of desired exhaust values, respectively, e.g. increased nitrogen oxide(s) ($NO_x$), may be avoided.

The first signal is effective to drive the combustion apparatus from a chaotic combustion state into a periodic combustion state.

Using a desired main frequency of the desired periodic combustion state for determining the second signal and, thus, the control signal of the combustion apparatus, allows driving the combustion state towards, more typically into the desired combustion state. Further, a damping of the amplitude of the oscillation of the parameter may be achieved.

Shifting the time series by a set time delay ($\tau_{set}$ which is different to the variable time delay $\tau_{var}$ used to determine the time dependent first signal and the difference signal, respectively) to determine the second signal and, thus, the control signal of the combustion apparatus, also allows changing the dominant frequency of the combustion state as well as damping the amplitude of the oscillation of the parameter. Note that the set time delay ($\tau_{set}$) determines the shift in the dominant frequency of the periodic combustion state.

Whether an open-loop control based on the desired main frequency or a feed-back control using a set time delay ($\tau_{set}$)

is more efficient to drive the apparatus into the desired periodic combustion state may depend on the details of the apparatus.

Both the variable time delay ($\tau_{art}$) for the first signal $S_1$ and the set time delay ($\tau_{set}$) for the second signal $S_2$ will typically be of the order of the time-period of the acoustic resonance frequency of the apparatus.

The set time delay ($\tau_{set}$) may be determined based on mechanical, geometrical, chemical and/or thermodynamic properties of the combustion apparatus. For example, the set time delay may be determined based on the acoustic resonance frequency of the combustion apparatus.

The parameter may be any variable or observable that participates in the chaotic behaviour of the thermoacoustic oscillations.

The term "thermoacoustic oscillations" intends to describe fluctuations and/or oscillations in a medium such as a gas which are due to a feedback interaction between an acoustic field in the medium, and temporal fluctuations in the heat release rate from combustion (or from a flame). The term "thermoacoustic oscillations" shall embrace oscillations in a flame (and associated quantities such as the unsteady heat release rate from the flame), and in an acoustic field within an apparatus at least partly enclosing the flame, typically within a combustion chamber of the apparatus, that emerge spontaneously due to a constructive feedback interaction between the flame and the acoustic field.

The parameter may be a pressure in the apparatus, a temperature in the apparatus, a density in the apparatus, a radiation power of the combustion (typically a chemiluminescence from the flame) or a parameter related to one or more of the pressure, the temperature, the density and the radiation power.

Typically, the parameter is the pressure. The pressure in the apparatus can reliably be measured with high temporal resolution.

The measured values of the parameter are typically high-pass filtered. Accordingly, a (long-term) drift of the parameter is eliminated.

The norm of the difference signal may be determined as an integral or a sum of (all) absolute amplitude values of the difference signal, e.g. as sum absolute pressure values. Alternatively, a root mean square value of the amplitude values of the difference signal may be determined as norm of the difference signal.

To determine the first signal, the variable time delay is typically varied starting from a value close the inverse of the dominant frequency in the oscillations until the norm of the difference signal reaches a minimum value, typically a global minimum value.

Accordingly, the amplitude of the first signal is small, typically close to zero if the apparatus is in a periodic state. Thus, the proposed controlling does not require analyzing the state of the apparatus and/or switching on and off the first signal.

In one embodiment, determining the time dependent first signal includes determining a difference between a first subset of the time series and a second subset of the time series, wherein the variable time delay between the first second subset and the second subset is determined so that so that a norm of the difference signal determined as difference between the first subset and the second subset is lowest.

Combining the first signal and the second signal is typically achieved by adding the first signal and the second signal or by forming a weighted sum of the first signal and the second signal.

However, other functions F of the first signal and the second signal may also be used as control signal.

Using the control signal may include feeding the input signal to an actuator coupled with the combustion apparatus.

Using the control signal may also include converting the control signal to an input signal for the actuator and feeding the input signal to the actuator. For example, the input signal may be a time dependent voltage.

For reasons of safety (for the actuator employed), the control signal or the input signal may be saturated prior to feeding to the actuator.

Converting and/or saturating the control signal may also already be achieved during combining the first signal and the second signal using an appropriate function (F).

The actuator is typically configured to convert the input signal, which is in the following also referred to as primary control signal into a secondary control signal suitable to influence the combustion apparatus.

Typically, the primary control signal and the secondary control signal, respectively, may be used to modulate a fuel-oxidant ratio, e.g. a fuel-air ratio, of fuel and oxidant used in the combustion apparatus for combustion.

This may be achieved by modulating a flow rate of the fuel and/or a flow rate of the oxidant.

Modulating the fuel-oxidant ratio may be achieved with little additional expense and has been found to be efficient for transferring the combustion apparatus from the chaotic combustion state into a non-chaotic combustion state.

Alternatively or in addition, the control signal or the saturated control signal may be converted into an acoustic signal, and the acoustic signal may be applied to the combustion apparatus.

Typically, the method is performed in a cyclic manner and/or a continuously.

Furthermore, the time series may be analyzed to determine a characteristic of a current combustion state, to change an input parameter of the function (F), e.g. increase a gain or weight of first signal if the current combustion state is still chaotic, and/or to change the set time delay.

The characteristic may be a measure of non-periodicity, a distance from a bifurcation or the like.

The characteristic may also be a fluctuation characteristic, in particular a measure for the amplitude oscillations such as a root-mean-square value (rms-value) of the measured values of the parameter or a measure of statistical dispersion of the measured values of the parameter such as the standard deviation. The fluctuation characteristic may be used to decide if the controlling is to be switched on.

According to an embodiment of a control device, the control device includes a sensor for measuring a parameter related to a combustion state of a combustion apparatus, a controller coupled with the sensor, and an actuator coupled with the controller. The controller is configured to receive measured values of the parameter from the sensor and to determine a time series from the measured values of the parameter, to shift the time series by a variable time delay for determining a time-shifted signal, and form a difference between the time-shifted signal and the time series for determining a time dependent first signal, so that a norm of the difference between the time-shifted signal and the time series is lowest, to determine a time dependent second signal different to the first signal, wherein the second signal is determined based on a frequency of a desired oscillating state of the combustion apparatus and/or wherein determining the second signal comprises shifting the time series by a set time delay, and to outputting a function (F) of the first signal and the second signal as a primary control signal. The actuator is configured to convert the primary control signal into a secondary control signal suitable to influence the combustion apparatus.

For example, the control device may be configured to vary the variable time delay, determine (a corresponding time-shifted signal and) a corresponding difference signal until the norm of the difference signal is lowest and reaches a minimum value, respectively, to determine the time dependent first signal.

In the following the control device is also referred to as controller.

Typically, the control device is configured to perform any of the methods described herein.

The controller may include an observer unit configured to determine a characteristic of a current state of the combustion apparatus using the time series of the parameter.

The observer unit may further be configured to change an input parameter of the function (F) and/or to change the set time delay.

The sensor is typically a pressure sensor, a temperature sensor or a light sensor.

The sensor may provide the measured values of the parameter as respective voltage values.

The actuator may be an acoustic actuator, an electromagnetically driven membrane, a valve, for example a fast-response valve, or a pump.

According to an embodiment, a controlled system includes a chamber, typically combustion chamber, and the control device coupled with the chamber.

Typically, the controlled system forms a jet engine, a gas turbine engine, a furnace, a boiler, rocket engine, or an afterburner.

BRIEF DESCRIPTION OF THE DRAWINGS

The components in the figures are not necessarily to scale, instead emphasis being placed upon illustrating the principles of the invention. Moreover, in the figures, like reference numerals designate corresponding parts. In the drawings.

DETAILED DESCRIPTION

In the following Detailed Description, reference is made to the accompanying drawings, which form a part hereof, and in which is shown by way of illustration specific embodiments in which the invention may be practiced. In this regard, directional terminology, such as "top," "bottom," "front," "back," "leading," "trailing," etc., is used with reference to the orientation of the Figure(s) being described. Because components of embodiments can be positioned in a number of different orientations, the directional terminology is used for purposes of illustration and is in no way limiting. It is to be understood that other embodiments may be utilized and structural or logical changes may be made without departing from the scope of the present invention. The following detailed description, therefore, is not to be taken in a limiting sense, and the scope of the present invention is defined by the appended claims.

Reference will now be made in detail to various embodiments, one or more examples of which are illustrated in the figures. Each example is provided by way of explanation, and is not meant as a limitation of the invention. For example, features illustrated or described as part of one embodiment can be used on or in conjunction with other embodiments to yield yet a further embodiment. It is intended that the present invention includes such modifications and variations. The examples are described using specific language which should not be construed as limiting the scope of the appending claims. The drawings are not scaled and are for illustrative purposes only. For clarity, the same elements or manufacturing steps have been designated by the same references in the different drawings if not stated otherwise.

Figure 1:
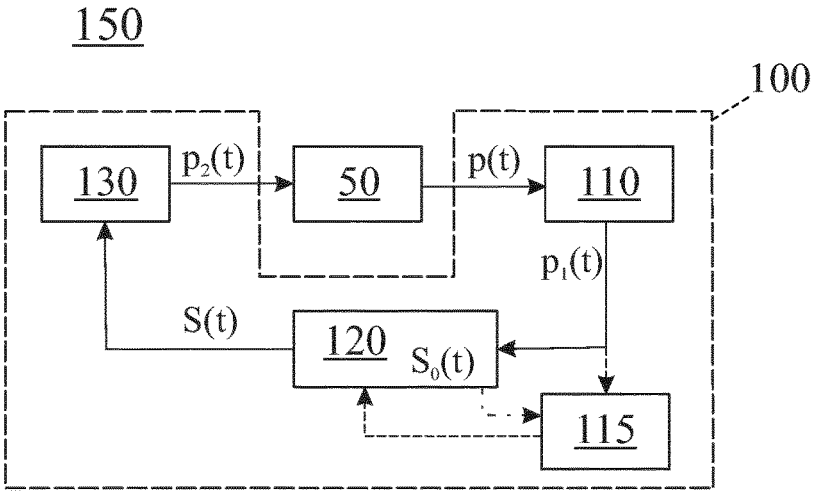
FIG. 1 schematically illustrates a controlled apparatus including a control device according to an embodiment.

With reference to FIG. 1, a first embodiment of a controlled apparatus 150 is explained. FIG. 1 shows a block diagram of the controlled apparatus 150.

In the exemplary embodiment, the controlled apparatus or system 150 consists of a combustion apparatus 50 and a control device 100 coupled with the combustion apparatus 50.

In the following the combustion apparatus 50 is also referred to as combustor 50.

A sensor 110 of the control device 100 is coupled with the combustor 50 to measure a parameter p related to a combustion state of the combustion apparatus 50 at different times t, for example pressure fluctuations.

The sensor 110 is further coupled with a controller 120 of the device 100 so that the controller 120 can receive measured values $p_1(t)$ of the parameter p.

The controller 120 may receive one measured values, typically several measured values $p_1$ per control cycle or a set of measured values $p_1$ per control cycle.

Further, the controller 120 may determine time series $S_0(t)$ of the measured values $p_1(t)$ of the parameter p. This may include appending the measured value(s) $p_1(t)$ as or to an end of a storage structure such as an array, and an optional subsequent high-pass filtering.

Based on the time series $S_0(t)$, the controller 120 may determine a primary control signal S(t) that is fed to an actuator 130 of the control device 100.

The actuator 130 is connected with the controller 120 and coupled with the combustor 50.

Accordingly, the actuator 130 may convert the primary control signal S(t) into a secondary control signal $p_2(t)$ that is used to influence the combustion apparatus 50 in such a way that a chaotic combustion state of the combustion apparatus 50 is left and/or that the combustion apparatus 50 reaches a desired (non-chaotic) combustion state.

For example, a fuel-oxidant ratio of the combustion apparatus 50 may be modulated using the secondary control signal $p_2(t)$.

Figure 2:
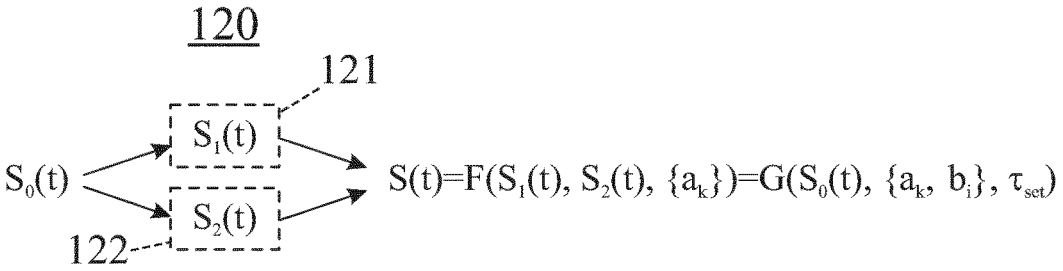
FIG. 2 illustrates the operation of the control device according to an embodiment.

As illustrated in FIG. 2, the primary control signal S(t) may be determined as function F of a first signal $S_1(t)$ and a second signal $S_2(t)$, typically as sum or weighted sum of the signals $S_1(t)$ and $S_2(t)$.

The first signal $S_1(t)$ may be determined by the controller 120 as follows.

A variable time delay $\tau_{var}$ may be initialized with a small value. Alternatively, the variable time delay $\tau_{var}$ may be initialized with a value close to a time-period which corresponds to a frequency of a dominant peak in the spectrum of the parameter.

Thereafter, a time-shifted signal $S_\tau(t)$ may be determined. Typically, the time-shifted signal $S_\tau(t)$ is determined by time-shifting the time series $S_0(t)$ by the variable time delay $\tau_{var}$:

$$S_\tau(t)=S_0(t-\tau_{var})$$

Thereafter, a difference signal $S_\Delta(t, \tau_{var})=S_\tau(t)-S_0(t)=S_0(t-\tau_{var})-S_0(t)$ may be determined.

Thereafter, a norm$|S_\Delta(t, \tau_{var})|$ of the difference signal $S_\Delta(t, \tau_{var})$ may be determined.

Thereafter, the variable time delay $\tau_{var}$ may be changed and the processes for determining the difference signal may be repeated using the variable time delay $\tau_{var}$.

Changing the variable time delay $\tau_{var}$ and determining the difference signal $S_\Delta(t, \tau_{var})$ are typically repeated until the norm of the difference signal $S_\Delta(t, \tau_{var})$ reaches a smallest value. The finally determined difference signal $S_\Delta$ may be used as the first signal $S_1$.

Different thereto, the second signal $S_2(t)$ may be determined by the controller 120 based on the frequency of a desired periodic state of the combustion apparatus 50. In this embodiment, the second signal $S_2(t)$ is an open-loop control signal $S_{OL}(t)$.

Alternatively, or in addition, the second signal $S_2(t)$ may be based on the time series $S_0(t)$ and a set time delay $\tau_{set}$.

For example, the second signal $S_2(t)$ may be determined as delayed time series $S_0(t-\tau_{set})$ or as a superposition $S_{OL}(t)+S_0(t-\tau_{set})$ or weighted superposition.

According to an embodiment, the controller 120 is a two-stage controller that outputs a function $F(S_1(t), S_2(t) \{a_k\})$ as control signal S(t).

Typically, F is a linear function: $F(S_1(t), S_2(t) \{a_k\})=a_1 S_1(t)+a_2 S_2(t)$ with weights (gains) $a_1$, $a_2$ ($\{a_k\}$). The gains may be changed in time to achieve the desired combustion state. For example, $a_2$ may be set to 0 as long as the $\tau_{var}$ optimization is performed.

A first of the two stages 121, 122 of the controller 120 is a feed-back control stage 121 and determines the first signal $S_1(t)$.

A second of the two stages 121, 122 of the controller 120 determines the second signal $S_2(t)$.

For example, the second stage 122 may determine the second signal $S_2(t)$ as a weighted sum of an open-loop control signal $S_{OL}(t)$ and a feedback signal $S_{FB}(t)$: $S_2(t)=b_1 S_{OL}(t)+b_2 S_{FB}(t)$, with weights (gains) $b_1$, $b_2$($\{b_i\}$).

Thus, the second stage 122 may be (may operate as) a feed-back control stage ($b_1=0$) or an open-loop control stage ($b_2=0$).

However, the second stage 122 may be (may operate as) a combined control stage ($b_1\neq0$, $b_2\neq0$).

The open-loop control signal $S_{OL}(t)$ may be determined as a time periodic function H having a period which is inversely related to a (main) frequency ($f_{OL}$) of a desired periodic combustion state: $S_{OL}(t)=H(t, f_{OL})$, such as a sinus function $\sin(2\pi*f_{OL}*t)$.

The feedback signal $S_{FB}(t)$ may be determined as time series $S_0(t)$ shifted by the set time delay $\tau_{set}$: $S_{FB}(t)=S_0(t-\tau_{set})$.

In other words, the controller 120 may also output a function $G(S_0(t), \{a_k, b_i\}, \tau_{set})$ as control signal S(t) as illustrated in FIG. 2.

The set time delay $\tau_{set}$ may be modified till the combustion apparatus 50 reaches a desired combustion state with a desired frequency.

As further illustrated in FIG. 1, the control device 100 may have an observer unit 115 for determining a characteristic of a current state of the combustion apparatus 50 using the measured values $p_1(t)$ or the time series $S_0(t)$ (indicted by the dashed-dotted arrow).

Depending on the characteristic, the observer unit 115 may change the function parameters $\{a_k, b_i\}$, $\tau_{set}$ explained above with respect to FIG. 2.

For example, the observer unit 115 may increase the weight $a_1$ if the characteristic indicates that the current state is still chaotic.

Further, the observer unit 115 may decide to activate the controlling only (e.g. by assigning non-zero values to the weights $a_1$ and/or $a_2$) if desired, e.g. if a fluctuation characteristic is above a respective threshold.

Likewise, the observer unit 115 may be configured to deactivate the controlling or part thereof based on the characteristic(s).

The observer unit 115 may also be an integral part of the controller 120.

Figure 3:
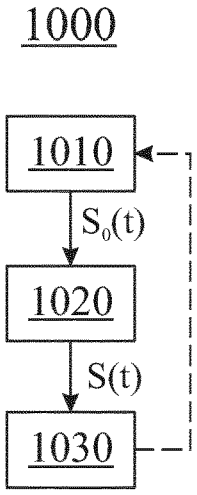
FIG. 3 illustrates a flow diagram of a method according to an embodiment.

FIG. 3 illustrates a flow diagram of a method 1000 that may be performed by the control device 100 explained above with respect to FIGS. 1, 2.

In a block 1010, a parameter (p) which is related to the combustion state such as a pressure in a combustion chamber or a (fluidically) connected upstream or downstream duct such as an exhaust pipe, for example a sound pressure, a temperature in the combustion chamber or the upstream or downstream duct, a temperature of a flame, and a radiation power of the flame is measured to obtain measured values ($p_1$) and therefrom a time series $S_0(t)$ of the parameter (p).

In a subsequent block 1020, a control signal S(t) may be determined on the basis of the time series $S_0(t)$. This is typically achieved as explained above with regard to FIG. 2 for the controller 120 by combining the first signal $S_1(t)$ and the second signal $S_2(t)$, more typically as a function $S(t)=G(S_0(t), \{a_k, b_i\}, \tau_{set})$.

In a subsequent block 1030, the control signal S(t) is used to influence the combustion apparatus 50.

For example, the control signal S(t) may be fed to a suitable actuator such as an electromagnetically driven membrane or a valve of the combustion apparatus to modulate a fuel-oxidant ratio of the combustion apparatus.

As illustrated by the dashed arrow in FIG. 3, method 100 is typically performed in a cyclic/continuous manner.

Figure 4:
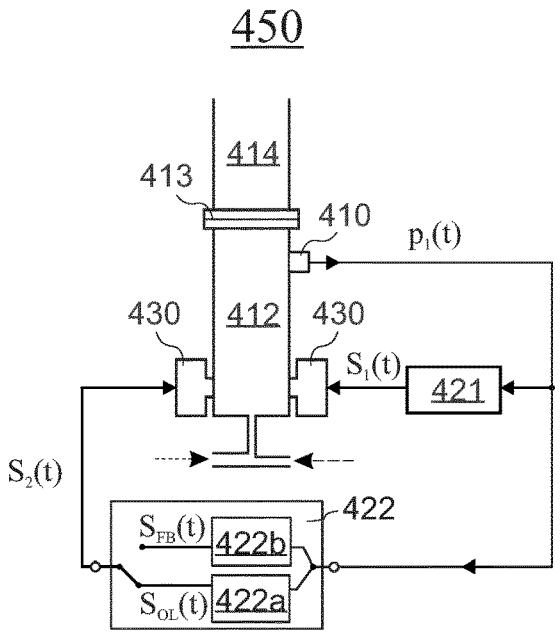
FIG. 4 schematically illustrates a controlled apparatus including a control device according to an embodiment.

FIG. 4 schematically illustrates an embodiment of a controlled combustion apparatus 450. The controlled combustion apparatus 450 is typically similar to the controlled apparatus 150 explained above with regard to FIGS. 1, 2, but described in more detail.

In the exemplary embodiment, the combustion apparatus 450 has two vertically orientated ducts 412, 414, typically steel ducts. The total length of the duct 412, 414 may be larger than 1 m and an inner diameter may be larger than about 10 cm.

Reactants, fuel and air in the exemplary embodiment, are injected at the bottom of the first (lower) duct 412 as indicated by the dashed arrows. Prior to passing the upper duct 414, the flow may meet a perforated plate 413 employed as a holder to stabilize the flame in the upper duct 414. The plate 413 may e.g. have a hexagonal pattern of the holes.

Considering a one-dimensional configuration in longitudinal direction, the flame remains stationary as the flame speed is equal to the speed of the unburnt flow at the flame location. By using perforated plates 413 as burners in a cross section of the reactant gas flow, heat is lost from the flame and the burning velocity decreases until it equals the unburnt mixture velocity. Therefore, a stable laminar flat flame confined in the upper duct 414 forming a combustion chamber is produced over a range of conditions.

However, hazardous self-excited instabilities may occur due to thermoacoustic coupling. For example, a constructive feedback coupling between unsteady fluctuations in the flame and the acoustics of the combustion chamber (formed by upper duct 414)—plenum (formed by lower duct 412) assembly.

A microphone 410 is attached to the lower duct 412 as sensor for measuring the pressure in the lower duct 412.

Alternatively, the microphone may be attached to the upper duct 414.

Furthermore, several microphones may be used as sensors.

In the exemplary embodiment, measured pressure values $p_1(t)$ may be transferred from the microphone 410 to the two stages 421, 422 of the two-stage controller 421, 422.

The controller stage 421 is implemented as feed-back control stage and configured to determine a first signal $S_1(t)$ as explained above with regard to FIG. 2 for the feed-back control stage 121.

The controller stage 422 may have two subunits (substages) 422*a*, 422*b*. The subunit 422*a* may determine the second signal $S_2(t)$ as open-loop control signal $S_{OL}(t)$, and subunit 422*b* may determine the second signal $S_2(t)$ a feedback signal $S_{FB}(t)$ as explained above with regard to FIG. 2.

Depending on the switch setting of the illustrated switch of the controller stage 422, the controller stage 422 may either provide the open-loop control signal $S_{OL}(t)$ (when the switch is in the switch setting shown in FIG. 4) or the feedback signal $S_{FB}(t)$ as second signal $S_2(t)$.

In the exemplary embodiment, each of the controller stages 421, 422 is connected with a corresponding compression driver 430 acting as actuators which are coupled with the lower duct 412. The actuators 430 are typically placed at identical axial distance from the flame in the duct 414.

The compression drivers 430 typically include a respective electromagnetically driven membrane. Accordingly, the combustion process may be influenced sufficiently powerful and swift. The (voltage) signals $S_1(t)$, $S_2(t)$, and $S(t)$, as described above may be used to generate a corresponding motion of the membrane. The motion of the membrane in turn generates pressure fluctuations that influence the thermoacoustic coupling between the acoustic field within the ducts 412, 414 and the flame.

Alternatively, the controller stages 421, 422 may be coupled with a common compression driver 430.

Figure 5:
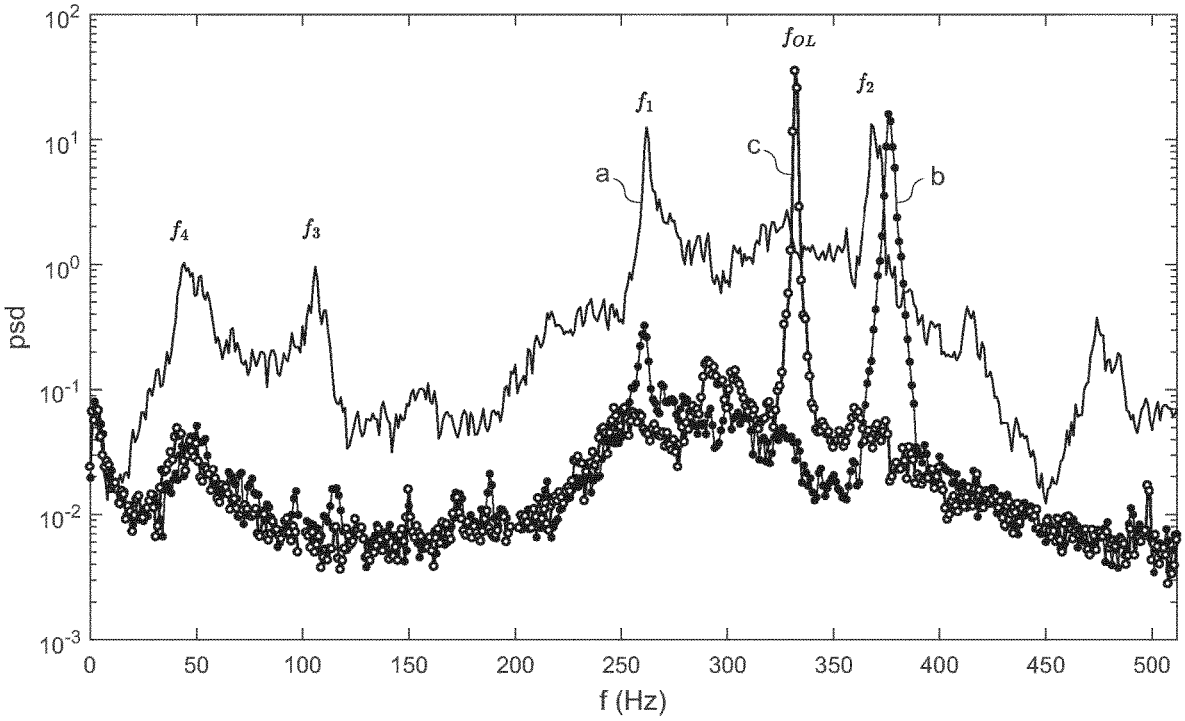
FIG. 5 shows spectra referring to states of the controlled apparatus illustrated in FIG. 4.

FIG. 5 shows frequency spectra a-c of pressure oscillations (psd) of the controlled combustor 450 shown in FIG. 4. Spectrum a corresponds to a chaotic combustion state of the combustor 450 with deactivated controller stages 421, 422 (uncontrolled combustion state). Spectrum a shows several pronounced broadband peaks, four of which are labelled as $f_1$ to $f_4$.

After switching-on the controller stages 421, the chaotic combustion state is left as indicated by the resulting spectrum b.

After further switching-on the controller stages 422 in the switch setting shown in FIG. 4 and using second signal $S_2(t)$ which is periodic with a desired frequency $f_{OL}$, the combustor 450 is driven to and locked in the desired periodic state with main frequency $f_{OL}$ of 333 Hz.

It can be shown experimentally, that periodic combustion behavior can be locked to a desired frequency by changing the delay of the phase shift feedback (using sub stage 422*b*) or by changing the frequency of the open loop (using sub stage 422*a*). This may be particularly helpful for instance in combustors employing passive devices, which usually feature narrowband damping defined by their geometrical characteristics.

With the control devices described herein, the frequency of the instability can be adjusted to fall within the frequency band where the installed passive methods are effective.

Furthermore, the control device can be easily adjusted to follow (adapt to) any changes in the damper properties induced by changes in the operating conditions of the combustor.

Figure 6:
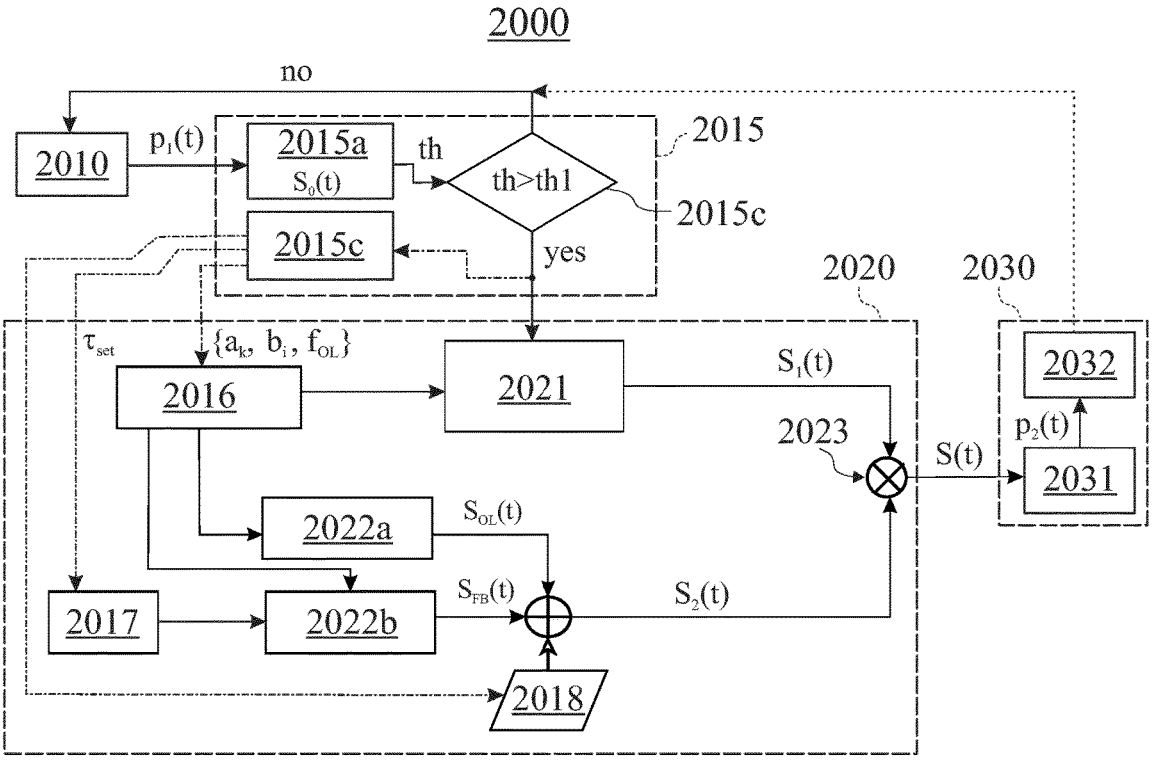
FIG. 6 illustrates a flow diagram of a method according to an embodiment.

FIG. 6 illustrates a flow diagram of a method 2000. The method 2000 is similar as the method 1000 explained above with regard to FIG. 3, but explained in more detail.

Method 2000 includes the blocks 2010, 2020 and 2030 which typically correspond to the respective blocks 1010, 1020 and 1030 of method 1000.

Furthermore, after measuring values $p_1(t)$ of the parameter in block 2010, the obtained time series $S_0(t)$ is initially analyzed in a block 2015 of method 2000.

For example, a value th representing amplitude fluctuations of the time series $S_0(t)$ (or the measured parameter values $p_1(t)$) may be analyzed in a sub block 2015*a* of block 2015.

If the value th is above a predetermined threshold th1, control block 2020 may be activated. Otherwise, method 2000 may return from sub block 2015*c* of block 2015 to block 2010.

Furthermore, based on the analysis in block 2015*a*, it may be decided in sub block 2015*c* to change one or more of the function parameters $\{a_k, b_i\}$, $\tau_{set}$, $f_{OL}$ explained above, when the value th is above the threshold th1. Accordingly, current values of the function parameters $\{a_k, b_i\}$, $\tau_{set}$, $f_{OL}$ may be updated in sub blocks 2016 and 2017 of block 2020, respectively.

Furthermore, it may be decided based on the analysis in block 2015*a* to change in a sub block 2018 of block 2020 a switch setting and, thus, how the open-loop control signal $S_{OL}(t)$ determined in a sub block 2022*a* of block 2020 and the feedback signal $S_{FB}(t)$ determined in a sub block 2022*b* of block 2020 are combined for forming the second signal $S_2(t)$.

Similar as explained above with regard to FIG. 2, the second signal $S_2(t)$ may be combined with a first signal $S_1(t)$ determined in sub block 2021 of block 2020 as difference signal having a lowest (minimum) norm.

The resulting primary control signal $S(t)$ may be converted in a sub block 2031 of block 2030 into a secondary control signal $p_2(t)$ that is used in sub block 2032 of block 2030 to influence the combustion apparatus and the combustion state of the combustion apparatus, respectively.

Thereafter, method 2000 may return to block 2010.

According to an embodiment of a method for controlling a chemical reaction in a state in which a parameter related to the chemical reaction reflects a chaotic behavior, the method includes measuring the parameter and determining a time series of the parameter. The time series is shifted by a variable time delay and a difference between the time-shifted signal and the time series is formed for determining a time dependent first signal, so that a norm of the difference between the time-shifted signal and the time series is lowest. A time dependent second signal is formed, wherein determining the time dependent second signal includes at least one of using a frequency of a desired oscillating state of chemical reaction and shifting the time series by a set time delay. The first signal and the second signal are combined for determining a control signal. The control signal is used to influence the chemical reaction.

Typically, the chemical reaction exhibits a self-excited instability (to be controlled). The self-excited instability may be due to thermoacoustic coupling. Accordingly, the chemical reaction may be an exothermic chemical reaction, more typically a combustion (reaction). The chemical reaction may also be so a called (nonlinear) chemical oscillator.

Typically, the chemical reaction is controlled under at least partially confined conditions, more typically in a reactor or a chamber, for example a combustion chamber.

It is however also conceivable that the methods described herein are used for a physical system having a self-excited instability such as pulsed combustors, lasers, thermal convection loops, and other natural and artificial systems where chaotic oscillations may appear and are desired to be controlled via an external stimulus (perturbation).

According to an embodiment of a method for influencing a self-excited instability of a chemical or physical system, in particular a respective artificial system, for example a thermoacoustic instability of a combustor, the method includes measuring a parameter related to the thermoacoustic instability and determining a time series of the parameter, determining a control signal, and using the control signal to influence the instability. Determining the control signal includes determining a time dependent first signal as a difference signal between the time series and a time-shifted signal, which is time-shifted with respect to the time series so that a distance, between the time series and the time-shifted signal is lowest, determining a time dependent second signal different to the first signal, and at least one of determining a function of the first signal and the second signal such as a sum or weighted sum, and combining the first signal and the second signal. Determining the second signal includes shifting the time series by a set time delay and/or using a desired frequency of the chemical or physical system. The control signal is typically used to influence the chemical or physical system and the self-excited instability, respectively.

According to an embodiment of a control device, the control device includes a sensor for measuring a parameter related to a self-excited instability of a chemical or physical system, for example a thermoacoustic instability in a combustor, a controller coupled with the sensor, and an actuator coupled with the controller. The controller is configured to receive measured values of the parameter from the sensor and to determine a time series from the measured values of the parameter, to shift the time series by a variable time delay for determining a time-shifted signal, and to form a difference between the time-shifted signal and the time series for determining a time dependent first signal, so that a norm of the difference between the time-shifted signal and the time series is lowest, and to determine a time dependent second signal different to the first signal. The second signal may be based on a frequency of a desired periodic state of the chemical or physical system and/or on shifting the time series by a set time delay. The control device is further configured to output a function (F) of the first signal and the second signal as a primary control signal. The actuator is configured to convert the primary control signal into a secondary control signal suitable to influence the chemical or physical system and the self-excited instability, respectively.

Although various exemplary embodiments of the invention have been disclosed, it will be apparent to those skilled in the art that various changes and modifications can be made which will achieve some of the advantages of the invention without departing from the spirit and scope of the invention. It will be obvious to those reasonably skilled in the art that other components performing the same functions may be suitably substituted. It should be mentioned that features explained with reference to a specific figure may be combined with features of other figures, even in those cases in which this has not explicitly been mentioned. Such modifications to the inventive concept are intended to be covered by the appended claims.

Spatially relative terms such as "under", "below", "lower", "over", "upper" and the like are used for ease of description to explain the positioning of one element relative to a second element. These terms are intended to encompass different orientations of the device in addition to different orientations than those depicted in the figures. Further, terms such as "first", "second", and the like, are also used to describe various elements, regions, sections, etc. and are also not intended to be limiting. Like terms refer to like elements throughout the description.

As used herein, the terms "having", "containing", "including", "comprising" and the like are open ended terms that indicate the presence of stated elements or features, but do not preclude additional elements or features. The articles "a", "an" and "the" are intended to include the plural as well as the singular, unless the context clearly indicates otherwise.

With the above range of variations and applications in mind, it should be understood that the present invention is not limited by the foregoing description, nor is it limited by the accompanying drawings. Instead, the present invention is limited only by the following claims and their legal equivalents.

The invention claimed is:

1. A method for controlling a combustion apparatus comprising a combustion state in which a parameter (p) related to the combustion state reflects a chaotic behavior, the method comprising:

measuring the parameter (p) and determining a time series ($S_0$, $p_1$) of the parameter (p);

shifting the time series ($S_0$) by a variable time delay ($\tau_{var}$) for determining a time-shifted signal ($S_\tau$), and forming a difference ($S_\tau$- $S_0$) between the time-shifted signal ($S_\tau$) and the time series ($S_0$) for determining a time dependent first signal ($S_1$), so that a norm of the difference ($S_\tau$- $S_0$) between the time-shifted signal ($S_\tau$) and the time series ($S_0$) is lowest;

determining a time dependent second signal ($S_2$) different to the first signal ($S_1$), wherein determining the time dependent second signal ($S_2$) comprises at least one of using a frequency ($f_{OL}$) of a desired periodic combustion state of the combustion apparatus, and shifting the time series ($S_0$) by a set time delay ($\tau_{set}$);

combining the first signal ($S_1$) and the second signal ($S_2$) for determining a control signal (S, $p_2$); and using the control signal (S, $p_2$) to influence the combustion apparatus.

2. The method of claim 1, wherein combining the first signal ($S_1$) and the second signal ($S_2$) comprises at least one of determining a function (F) of the first signal ($S_1$) and the second signal ($S_2$), determining a sum of the first signal ($S_1$) and the second signal ($S_2$), and determining a weighted sum of the first signal ($S_1$) and the second signal ($S_2$).

3. The method of claim 1, wherein the norm corresponds to a sum of absolute amplitude values of the difference ($S_\tau$-$S_0$) between the time-shifted signal ($S_\tau$) and the time series ($S_0$), and/or wherein the norm corresponds to a root mean square value of the amplitude values of the difference ($S_\tau$-$S_0$) between the time-shifted signal ($S_\tau$) and the time series ($S_0$).

4. The method of claim 1, wherein the parameter is a pressure in the apparatus, a temperature in the apparatus, a density in the apparatus, a radiation power of the combustion or a parameter related to at least one of the pressure, the temperature, the density and the radiation power.

5. The method of claim 1, further comprising analyzing the time series ($S_0$) to determine a characteristic of a current state of the combustion, changing an input parameter ({a}) of the function (F) and/or changing the set time delay ($\tau_{set}$).

6. The method of claim 1, wherein determining the time series ($S_0$) comprises high-pass filtering the measured parameter ($p_1$), and/or wherein determining the time dependent first signal ($S_1$) comprises varying the variable time delay ($\tau_{var}$).

7. The method of claim 1, wherein using the control signal (S, $p_2$) comprises at least one of:

saturating the control signal (S) to form a saturated control signal;

feeding the control signal (S) or the saturated control signal to an actuator coupled with the combustion apparatus;

modulating a fuel-oxidant ratio of the combustion apparatus;

modulating a flow rate of the combustion apparatus;

converting the control signal (S) or the saturated control signal into an acoustic signal; and applying the acoustic signal to the combustion apparatus.

8. The method of claim 1, wherein the method is performed in a cyclic manner and/or continuously.

9. A control device, comprising:

a sensor for measuring a parameter (p) related to a combustion state of a combustion apparatus;

a controller connected with the sensor and configured to:

receive measured values ($p_1$) of the parameter (p) from the sensor and to determine a time series ($S_0$) of the measured values of the parameter (p);

shift the time series ($S_0$) by a variable time delay (96$_{var}$) for determining a time-shifted signal ($S_\tau$), and form a difference ($S_\tau$- $S_0$) between the time-shifted signal ($S_\tau$) and the time series ($S_0$) for determining a time dependent first signal ($S_1$), so that a norm of the difference ($S_\tau$- $S_0$) between the time-shifted signal ($S_\tau$) and the time series ($S_0$) is lowest;

determine a time dependent second signal ($S_2$) different to the first signal ($S_1$), wherein the second signal ($S_2$) is determined based on a frequency ($f_{OL}$) of a desired periodic state of the combustion apparatus and/or wherein determining the second signal ($S_2$) comprises shifting the time series ($S_0$) by a set time delay ($\tau_{set}$); and output a function (F) of the first signal ($S_1$) and the second signal ($S_2$) as a primary control signal (S); and an actuator connected with the controller and configured to convert the primary control signal (S) into a secondary control signal ($p_2$) suitable to influence the combustion apparatus.

10. The device of claim 9, wherein the sensor is a pressure sensor, a temperature sensor or a light sensor.

11. The device of claim 9, wherein the actuator is an acoustic actuator, an electromagnetically driven membrane, a valve or a pump.

12. The device of claim 9, wherein the control device comprises an observer unit configured to determine at least one of:

a characteristic of a current state of the combustion apparatus using the time series ($S_0$) or the measured values ($p_1$) of the parameter (p);

using the characteristic for changing an input parameter ({a}) of the function (F); and using the characteristic for changing the set time delay ($\tau_{set}$).

13. The device of claim 9, wherein control device is configured to:

measure the parameter (p) and determining a time series ($S_0$, $p_1$) of the parameter (p);

shift the time series ($S_0$) by a variable time delay ($\tau_{var}$) for determining a time-shifted signal ($S_\tau$), and forming a difference ($S_\tau$- $S_0$) between the time-shifted signal ($S_\tau$) and the time series ($S_0$) for determining a time dependent first signal ($S_1$), so that a norm of the difference ($S_\tau$- $S_0$) between the time-shifted signal ($S_\tau$) and the time series ($S_0$) is lowest;

determine a time dependent second signal ($S_2$) different to the first signal ($S_1$), wherein determining the time dependent second signal ($S_2$) comprises at least one of using a frequency ($f_{OL}$) of a desired periodic combustion state of the combustion apparatus, and shifting the time series ($S_0$) by a set time delay ($\tau_{set}$);

combine the first signal ($S_1$ and the second signal ($S_2$) for determining a control signal (S, $p_2$); and use the control signal S, $p_2$) to influence the combustion apparatus.

14. A controlled system comprising a chamber and the control device claim 9 coupled with the chamber.

15. The system of claim 14, wherein the chamber is a combustion chamber, and/or wherein the controlled system is formed by or includes at least one of a jet engine, a rocket engine, a gas turbine engine, a furnace, a boiler, or an afterburner.

* * * * *